US009365407B2

(12) United States Patent
Grunewald

(10) Patent No.: US 9,365,407 B2
(45) Date of Patent: Jun. 14, 2016

(54) DEVICE FOR EFFICIENTLY TRANSFERRING A BEVERAGE FROM A DISPENSER TO A CONTAINER

(71) Applicant: Jeffrey M. Grunewald, Dyer, IN (US)

(72) Inventor: Jeffrey M. Grunewald, Dyer, IN (US)

( * ) Notice: Subject to any disclaimer, the term of this patent is extended or adjusted under 35 U.S.C. 154(b) by 205 days.

(21) Appl. No.: 13/860,122

(22) Filed: Apr. 10, 2013

(65) Prior Publication Data

US 2014/0305547 A1 Oct. 16, 2014

(51) Int. Cl.
*B67D 7/00* (2010.01)
*B67D 1/14* (2006.01)

(52) U.S. Cl.
CPC ..... *B67D 7/005* (2013.01); *B67D 1/145* (2013.01); *B67D 1/1422* (2013.01)

(58) Field of Classification Search
CPC ..... B67D 7/005; B67D 1/0042; B67D 1/02; B67D 1/025; B67D 1/145; B67D 1/1422
USPC ..... 141/374; 222/566–574
See application file for complete search history.

(56) References Cited

U.S. PATENT DOCUMENTS

| | | | | |
|---|---|---|---|---|
| 926,550 | A * | 6/1909 | Gray | 141/387 |
| 2,006,194 | A * | 6/1935 | Bertschinger | 222/88 |
| 2,083,281 | A * | 6/1937 | Spayd | 222/400.7 |
| 2,165,605 | A * | 7/1939 | Baker | 137/12.5 |
| 3,024,946 | A * | 3/1962 | Forsyth | 222/41 |
| 4,905,743 | A * | 3/1990 | Gray | 141/198 |
| 7,040,359 | B2 * | 5/2006 | Younkle | 141/255 |
| 7,278,454 | B2 * | 10/2007 | Younkle | 141/374 |
| D612,203 | S * | 3/2010 | Bollin | D7/397 |
| 2006/0033379 | A1 * | 2/2006 | Frear | 299/107 |
| 2009/0266443 | A1 * | 10/2009 | Browne-Wilkinson | 141/198 |
| 2013/0256340 | A1 * | 10/2013 | Matsie | 222/394 |
| 2015/0075673 | A1 * | 3/2015 | Keeling | B67D 1/08 141/374 |

FOREIGN PATENT DOCUMENTS

| | | | |
|---|---|---|---|
| CN | 201909082 | * | 7/2011 |
| DE | 102009059687 | A1 * | 6/2011 |

OTHER PUBLICATIONS

English abstract of Yuhuan (CN 201909082).*

* cited by examiner

*Primary Examiner* — Mark A Laurenzi
*Assistant Examiner* — Andrew StClair
(74) *Attorney, Agent, or Firm* — Seyfarth Shaw LLP

(57) ABSTRACT

A device that efficiently transfers a beverage from a dispenser to a container with minimal loss of the beverage, and in the case of a gaseous beverage, with minimal formation of a foam "head" at the top of the beverage. A tubular element is designed to be retrofit to an existing beverage dispensing outlet, such as a spigot. The tubular element has a length selected to introduce the beverage directly out the bottom of the element and into the bottom of the container being filled with the beverage. The container fills with the beverage, such that the fill line of the beverage moves from the bottom of the glass, horizontal with the opening at the bottom of the element, then upward around the tubular element toward the rim of the container, thus minimizing the amount of beverage that may splash against the sides and outside of the container, and minimizing the amount of head forming at the top of a carbonated beverage.

5 Claims, 2 Drawing Sheets

DEVICE FOR EFFICIENTLY TRANSFERRING A BEVERAGE FROM A DISPENSER TO A CONTAINER

FIELD OF THE INVENTION

The present disclosure relates to a device for the efficient transfer of a beverage from a dispenser to a container, and more particularly for dispensing a foamaceous beverage into a drinking vessel, as from a beer tap.

BACKGROUND

Beverages are often stored in larger containers for distribution from places of manufacture to places of consumption. These places of consumption include bars, restaurants, and other business establishments, where the beverages are transferred from the storage containers, as for example beer kegs, through dispensers, such as beer taps, into smaller containers, such as mugs or glasses, for consumption by individuals.

The process of transferring a beverage from a storage container to smaller containers inevitably results in the loss of some amount of the beverage, as the beverage is repeatedly dispensed into one container after another. A portion of the beverage may splash against the sides and to the outside of the container as the container is filled. A portion of the beverage may also fall completely outside of the container as the container is moved into position below the dispenser, filled, and then moved away from the dispenser.

The process is particularly troublesome for gaseous or foamaceous beverages, as the gases form bubbles in the beverage and the bubbles escape, creating a foam or fizz at the top of the beverage liquid and increasing the likelihood that some of the beverage will be lost. The most common type of gaseous beverage is the carbonated beverage, which contains carbon dioxide dissolved in water. Beverages may be artificially carbonated, such as when carbon dioxide is introduced into sodas to give them a fizzy sensation; beverages may also be naturally carbonated, such as when carbon dioxide is introduced to beer through the process of fermentation.

The formation of foam or fizz from the escape of bubbles to the top of a beverage is called a "head." A certain size of head may be desired by the individuals consuming the carbonated beverage, as they consider the head to be indicative of a particular aroma, aesthetic, or other quality of the beverage. However, these same individuals may view a relatively large head as undesirable, as the head detracts from the volume of the beverage liquid they consume.

A relatively large head is also viewed as undesirable by the person dispensing the beverage into a container. The head increases the likelihood that some of the beverage may splash against the side or fall outside the container as it is filled. The head also increases the amount of time required to serve the beverage, as the person dispensing the beverage waits a longer time between dispensing the liquid into each container to allow time for the head on each beverage to dissipate.

The retailers selling beverages at places of consumption desire to achieve a quicker and more efficient means of delivering beverages in containers for consumption by their patrons, but the retailers may also be concerned with the cost of any device required to achieve this desire.

SUMMARY

The present application discloses a device that efficiently transfers a beverage from a dispenser to a container with minimal loss of the beverage, and in the case of a gaseous beverage, minimal formation of a foam "head" at the top of the beverage. More particularly, the present invention is a device that can be readily retrofit to existing dispensing equipment, and with minimal installation effort.

In one form of the invention, a tubular element is adapted to fit into the existing outlet of a beverage dispenser, such as a tap spigot, to direct the beverage away from the existing outlet (or tip) of the dispenser, and then to a new outlet formed by the tubular element which is further downstream from the tip. The length of the tubular element is such that the beverage is introduced out the bottom of the element and substantially directly into the bottom of the container being filled. The container fills with the beverage, such that the fill line of the beverage moves from the bottom of the glass, horizontal with the opening at the bottom of the element, then upward along the tubular element toward the rim of the glass. This device minimizes the amount of beverage that may splash against the sides and outside of the container, and in the case of a gaseous beverage, minimizes the formation of a head at the top of the beverage.

This form of the invention is designed so as to be readily retrofit to a retailer's current dispensing system. The tubular element has an upstream end with an external diameter that is approximately the same as that of the internal diameter of the existing outlet (e.g., the spigot outlet). A notch or cut-out is formed in the upstream end of the element extending slightly along the longitudinal length of the tubular element. The tubular element can thereby be fit within the spigot through a swedging arrangement, for an interference fit within the existing outlet (spigot). This fitting can be accomplished with minimal effort by the installer. The notch is furthermore sized and shaped so as to align with a vent hole typically found in a tap housing, for more effective drainage of beer.

The foregoing objects and advantages of the invention will be further understood with reference to the accompanying drawings and detailed description related thereto, in which:

DETAILED DESCRIPTION

A detailed description of a preferred embodiment of the inventive device is disclosed herein. However, it is to be understood that the disclosed embodiment is merely exemplary of the device, which may be embodied in other forms. Therefore, specific functional details disclosed herein are not to be interpreted as limiting, but merely as a basis for the claims and as a representative basis for teaching one skilled in the art to variously employ the present disclosure.

Generally, the device disclosed herein can include, and may be implemented in conjunction with, a number of different beverages, containers, dispensers and dispensing systems. It is disclosed herein in the environment of a beer dispensing assembly, such as what one may find in a typical bar setting.

Figure 1:
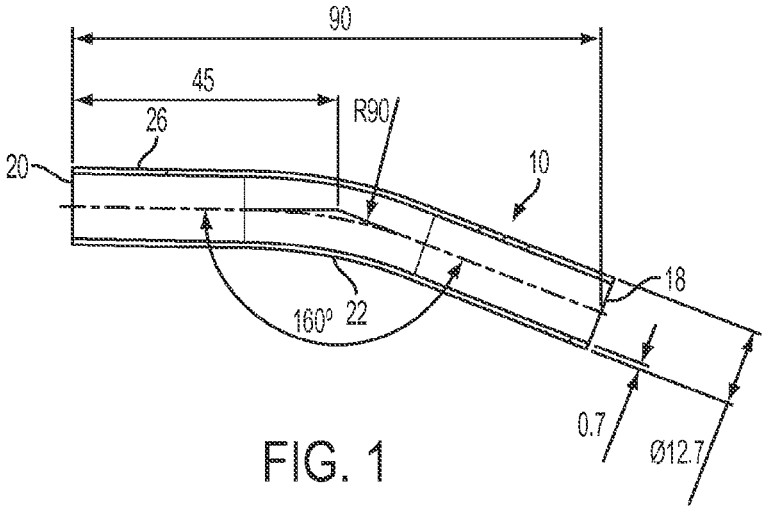
FIG. 1 is a sectional side view of a tubular element made in accordance with an aspect of the present invention.
Figure 2:
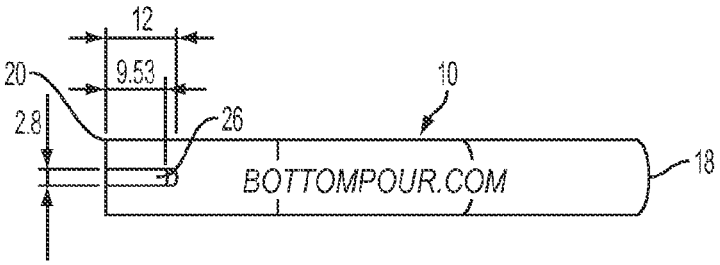
FIG. 2 is an elevational view of the tubular element of FIG. 1.
Figure 3:
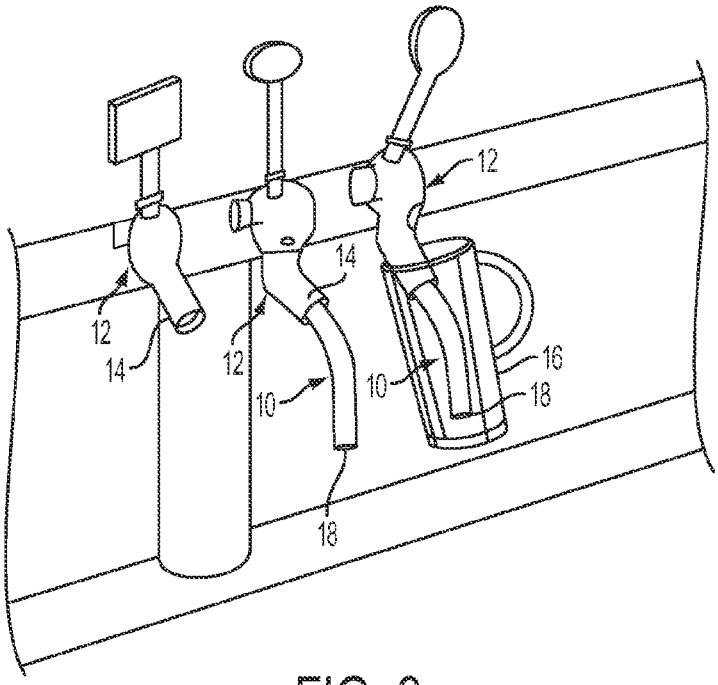
FIG. 3 is a view showing the tubular element of FIGS. 1 and 2 installed in a beer dispensing assembly.
Figure 4:
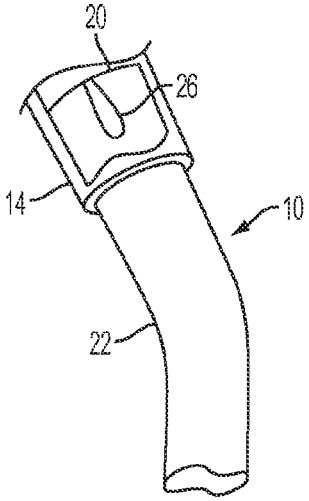
FIG. 4 is an enlarged view of a spigot with the tubular element located therein, partly broken away for detail.

FIG. 1 depicts a dispenser-to-container beverage transfer device according to one or more embodiments of the present invention. The device 10 is a tubular element, which is here made of metal, such as stainless steel. It could be made of other materials, however, such as plastic, as will be understood by those of skill in the art. The tubular element functions as an extension of the beer tap (the beer tap 12 being generally shown in FIG. 4), and is designed to be fit within the outlet of the tap, shown here as spigot 14.

The device 10 has a longitudinal (or long) length selected so that the device 10, when fit to the spigot 14, will extend to substantially the bottom of the container to be filled. Here, that container is shown as a glass or mug 16. The downstream end of the device 10 is indicated at 18. The upstream end, which fits within the spigot 14, is indicated at 20. There is a slight bend 22 provided in the device 10, which enables the downstream end to pitch slightly more downwardly at an angle when installed.

Figure 5:
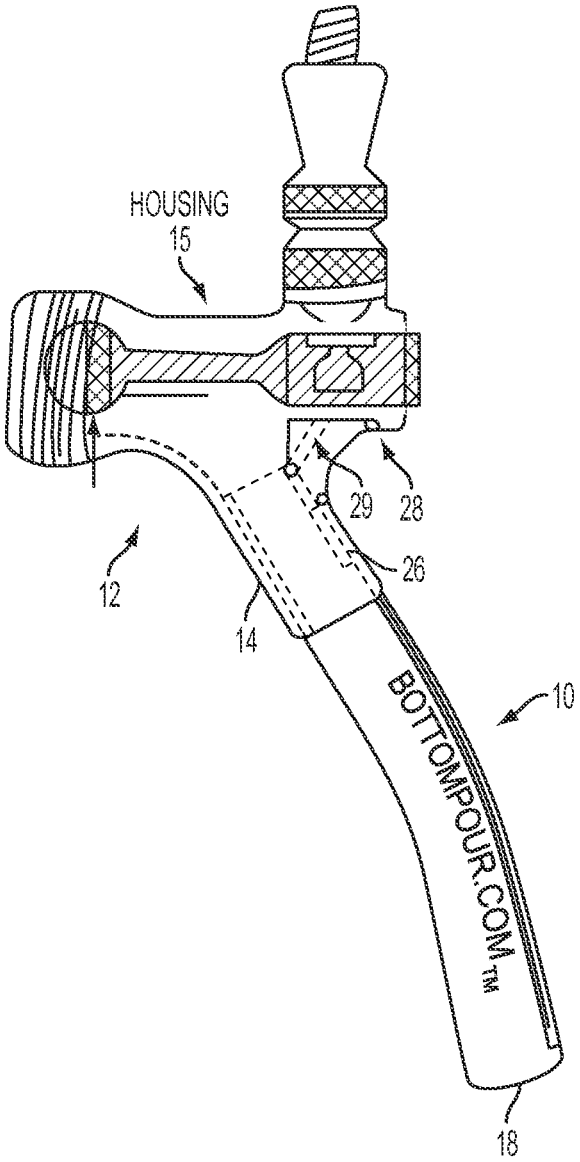
FIG. 5 is another enlarged view of a tap with the tubular element located therein in a beer drawing configuration.

The upstream end 20 has a notch 26 formed therein, which extends from the end slightly along the longitudinal axis of the device 10. The outer diameter of the upstream end 20 is sized to be about the same as the inner diameter of the spigot 14. In this embodiment, that outer diameter was chosen at 12.7 mm. The length of this particular notch was selected at 9.53 mm. Note that there is a small angulation to the downstream end of the notch 26. Looking at FIG. 5, a draining feature of the invention is depicted. A typical beer tap will have a venting structure in the housing 15 of the tap, in communication with the spigot 14. As shown here, there is a vent hole 28 which communicates with an interior line or conduit 29 formed in the housing. This provides an access for air to enter into the housing 15, to allow beer to better drain therefrom. The notch 26 of the tubular element 10 is designed so that it will reach the interior vent hole of the conduit 29 when inserted into the spigot 14. This then enables the draining function to be effected, as the interior vent hole of the conduit 29 will now continue to communicate with the interior of the tap housing.

As can now be appreciated, an installer can take an embodiment of the device 10, and insert the upstream end 20 into the spigot 14. By driving, or swedging, the device up into the spigot, the upstream end 20 compresses in diameter by virtue of the notch 26. This enables a good solid interference fit within the spigot 14. The tubular element 10 can thereby be readily retrofit to a standard beer tap assembly, such that a retailer may retrofit the individual beer taps on its beer dispensing system with these devices. The snug fit of the element around the inside of the dispenser ensures that the beer will be directed from the tip of the dispenser outlet to the interior of the device 10, and thence angled downward, such that the beer flows through the element, past the neck and further downward through the body of the element. The beer is introduced out the bottom of the element directly into the bottom of a glass being filled, and the fill line moves upward from the bottom of the element toward the rim of the glass and around the tubular element 10. This device minimizes the amount of beer that splashes against the sides and outside of the glass and also minimizes the size of the foam "head" that forms at the top of the beer.

While the invention has been described with respect to specific examples including a presently preferred mode of carrying out the invention, those skilled in the art will appreciate that there are numerous variations and permutations of the above described systems and techniques that fall within the spirit and scope of the invention.

What is claimed is:

1. A dispenser-to-container beverage transfer device, comprising:

a beverage dispensing apparatus including a housing having an outlet and a vent hole formed in the housing and in communication with the outlet;

a tubular element having a length, an upstream end having an upstream end outer diameter, a notch formed at the upstream end and extending generally along a portion of the length, and a downstream end located downstream of the upstream end;

the upstream end inserted into the outlet and having an outer diameter being approximately equal to an internal diameter of the outlet, the upstream end compressing in diameter by virtue of the notch creating an interference fit between the tubular element and the outlet;

the notch and a portion of the tubular element containing the notch extending to and aligning with the vent hole and being used in draining the housing;

the length of the tubular element extending substantially to a bottom of a container within which a beverage is to be dispensed when the device is in use; and the downstream end of the tubular element introducing a beverage from the dispenser directly to the bottom of the container when the device is in use.

2. The device of claim 1, wherein the tubular element is a metal tube.

3. The device of claim 1, wherein the tubular element has a bend provided between the upstream and the downstream ends, the bend forming a neck that angles the downstream end more downwardly when the tubular element is installed.

4. The device of claim 1, wherein the upstream end outer diameter is about 12.7 mm.

5. The device of claim 1, wherein the notch extends from the upstream end about 9.53 mm along the portion of the length, and has a width of about 2.8 mm.

* * * * *